US005595392A

United States Patent [19]

Casillas

[11] Patent Number: 5,595,392

[45] Date of Patent: Jan. 21, 1997

[54] IN-LINE ROLLER ICE SKATE COMBINATION

[76] Inventor: Anthony Casillas, 3400 Roseview Ave., Los Angeles, Calif. 90065

[21] Appl. No.: 509,495

[22] Filed: Jul. 31, 1995

[51] Int. Cl.[6] ..... A63C 17/18; A63C 17/06

[52] U.S. Cl. ..... 280/7.13; 280/7.14; 280/11.22; 280/11.27; 301/124.2

[58] Field of Search ..... 280/7.12, 7.13, 280/7.14, 11.12, 11.19, 11.22, 11.27, 11.3, 11.33; 301/124.2

[56] References Cited

U.S. PATENT DOCUMENTS

| | | | |
|---|---|---|---|
| 1,266,386 | 5/1918 | Barr | 280/7.13 |
| 1,530,211 | 3/1925 | Siemnash | 280/11.22 X |
| 4,058,324 | 11/1977 | Dallaire | 280/11.22 |
| 4,763,957 | 8/1988 | Poehlmann et al. | 301/124.2 X |
| 5,253,884 | 10/1993 | Landers | 280/11.27 |
| 5,441,286 | 8/1995 | Pozzobon | 280/11.27 |

FOREIGN PATENT DOCUMENTS

| | | | |
|---|---|---|---|
| 2328256 | 1/1975 | Germany | 280/7.13 |
| 658011 | 10/1951 | United Kingdom | 301/124.2 |
| 659249 | 10/1951 | United Kingdom | 301/124.2 |

*Primary Examiner*—Brian L. Johnson
*Assistant Examiner*—Bridget Avery

[57] ABSTRACT

A skate for rolling or slide traversing over a ground surface. The inventive device includes a boot securable to a human foot and including a pair of spaced mounting plates projecting from a lower surface thereof. A plurality of axles extend between the plates and support either a plurality of wheels or an ice blade beneath the skate. The axles may include a releasable cam to enable interchanging of the wheels and blade without a use of tools.

1 Claim, 4 Drawing Sheets

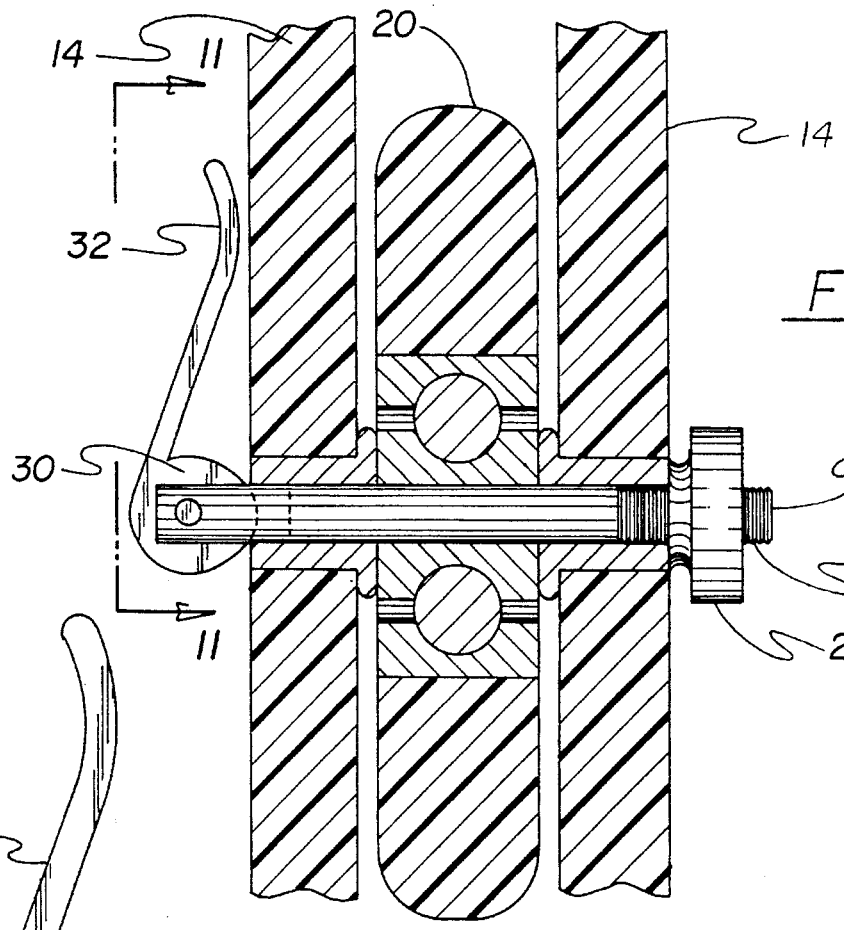
FIG. 9
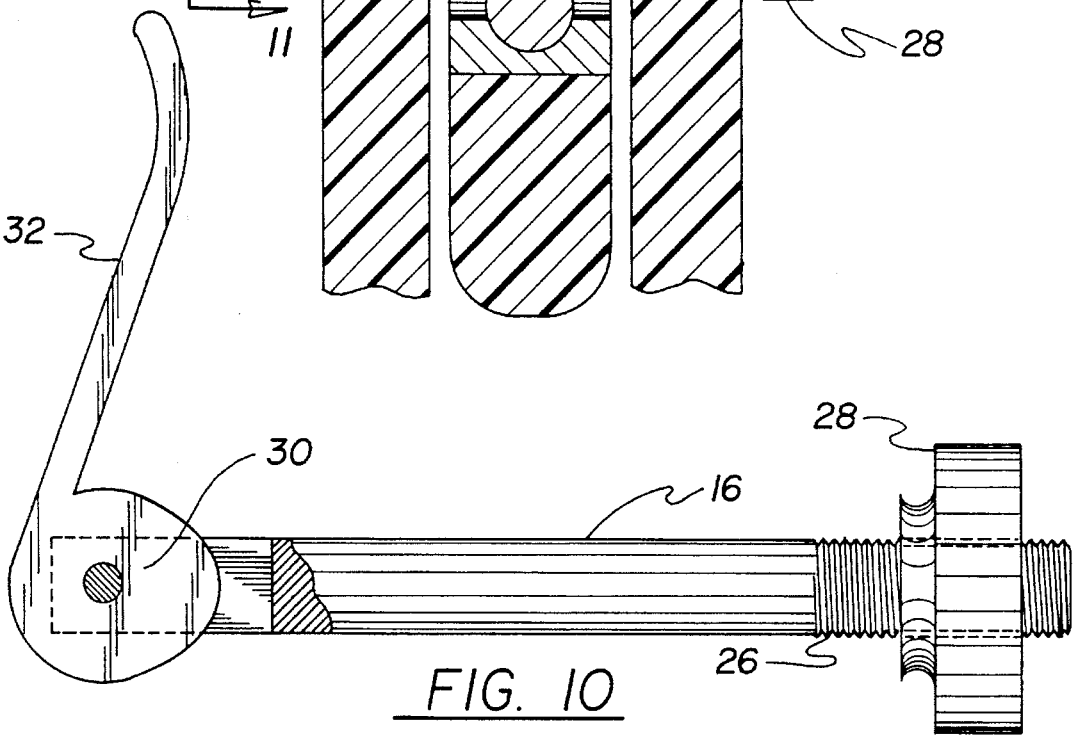
FIG. 10
FIG. 11
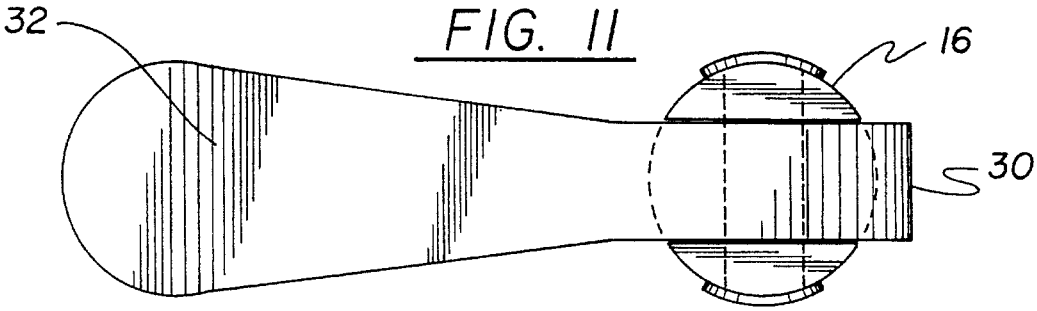

IN-LINE ROLLER ICE SKATE COMBINATION

BACKGROUND OF THE INVENTION

1. Field of the Invention

The present invention relates to skating devices and more particularly pertains to a in-line roller ice skate for facilitating rolling or sliding traversing over a ground surface.

2. Description of the Prior Art

The use of skating devices is known in the prior art. More specifically, skating devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art skating devices include U.S. Pat. No. 5,193,827: U.S. Pat. No. 4,008,901; U.S. Pat. No. 4,324,408; U.S. Pat. No. 4,699,390; U.S. Pat. No. 4,150,499: and U.S. Pat. No. 4,351,536.

While these devices fulfill their respective, particular objectives and requirements, the aforementioned patents do not disclose an in-line roller ice skate for facilitating rolling or sliding traversing over a ground surface which includes a boot securable to a human foot and including a pair of spaced mounting plates projecting from a lower surface thereof, and a plurality of axles extending between the plates and supporting either a plurality of wheels or an ice blade beneath the skate, wherein the axles include a releasable cam to enable interchanging of the wheels and blade without a use of tools.

In these respects, the in-line roller ice skate according to the present invention substantially departs from the conventional concepts and designs of the prior art, and in so doing provides an apparatus primarily developed for the purpose of facilitating rolling or sliding traversing over a ground surface.

SUMMARY OF THE INVENTION

In view of the foregoing disadvantages inherent in the known types of skating devices now present in the prior art, the present invention provides a new in-line roller ice skate construction wherein the same can be utilized for facilitating rolling or sliding traversing over a ground surface. As such, the general purpose of the present invention, which will be described subsequently in greater detail, is to provide a new in-line roller ice skate apparatus and method which has many of the advantages of the skating devices mentioned heretofore and many novel features that result in a in-line roller ice skate which is not anticipated, rendered obvious, suggested, or even implied by any of the prior art skating devices, either alone or in any combination thereof.

To attain this, the present invention generally comprises a skate for rolling or sliding traversing over a ground surface. The inventive device includes a boot securable to a human foot and including a pair of spaced mounting plates projecting from a lower surface thereof. A plurality of axles extend between the plates and support either a plurality of wheels or an ice blade beneath the skate. The axles may include a releasable cam to enable interchanging of the wheels and blade without a use of tools.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new in-line roller ice skate apparatus and method which has many of the advantages of the skating devices mentioned heretofore and many novel features that result in a in-line roller ice skate which is not anticipated, rendered obvious, suggested, or even implied by any of the prior an tool guides, either alone or in any combination thereof.

It is another object of the present invention to provide a new in-line roller ice skate which may be easily and efficiently manufactured and marketed.

It is a further object of the present invention to provide a new in-line roller ice skate which is of a durable and reliable construction.

An even further object of the present invention is to provide a new in-line roller ice skate which is susceptible of a low cost of manufacture with regard to both materials and labor, and which accordingly is then susceptible of low prices of sale to the consuming public, thereby making such in-line roller ice skates economically available to the buying public.

Still yet another object of the present invention is to provide a new in-line roller ice skate which provides in the apparatuses and methods of the prior art some of the advantages thereof, while simultaneously overcoming some of the disadvantages normally associated therewith.

Still another object of the present invention is to provide a new in-line roller ice skate for facilitating rolling or sliding traversing over a ground surface.

Yet another object of the present invention is to provide a new in-line roller ice skate which includes a boot securable to a human foot and including a pair of spaced mounting plates projecting from a lower surface thereof, and a plurality of axles extending between the plates and supporting either a plurality of wheels or an ice blade beneath the skate, wherein the axles include a releasable cam to enable interchanging of the wheels and blade without a use of tools.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 9 is an enlarged elevation view of an individual axle of the invention.

FIG. 10 is an exploded elevation view of one of the axles.

FIG. 11 is an end elevation view taken from line 11—11 of FIG. 9.

DESCRIPTION OF THE PREFERRED EMBODIMENT

Figure 1:
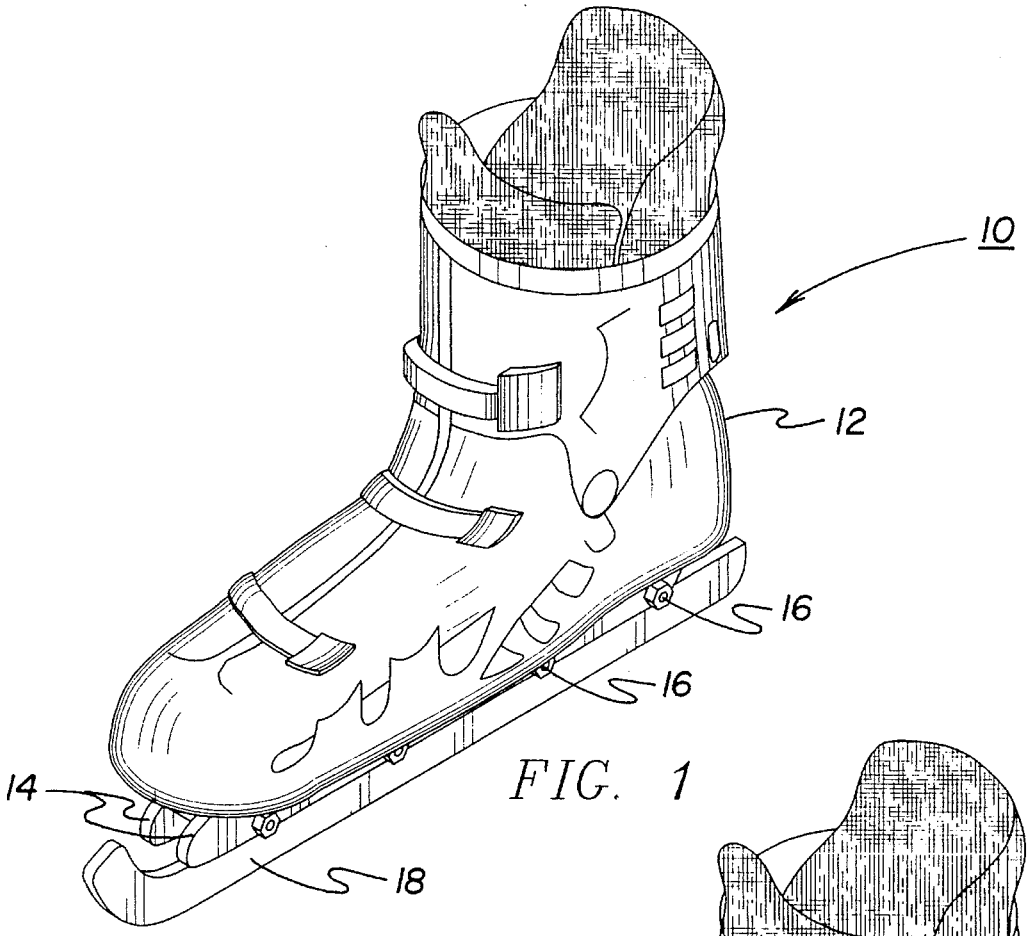
FIG. 1 is an isometric illustration of an in-line roller ice skate according to the present invention having an ice blade coupled thereto.
Figure 2:
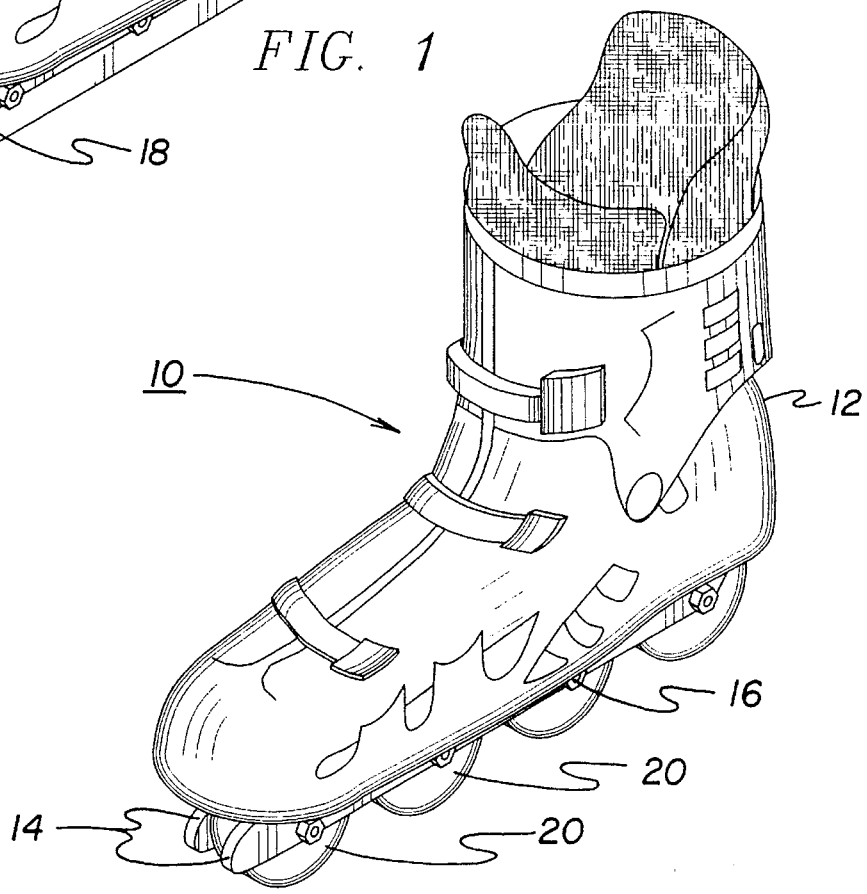
FIG. 2 is an isometric illustration of the invention including a plurality of wheels.

With reference now to the drawings, and in particular to FIGS. 1–11 thereof, a new in-line roller ice skate embodying the principles and concepts of the present invention and generally designated by the reference numeral 10 will be described.

More specifically, it will be noted that the in-line roller ice skate 10 comprises a boot 12 adapted to be the secured to a human foot in a conventionally known manner. A pair of mounting plates 14 are positioned in a substantially spaced and parallel orientation relative to one another and extend longitudinally along a lower surface of the boot 12 so as to project downwardly therefrom. A plurality of support axles 16 extend between the mounting plates 14 and cooperate to secure either an ice blade 18 between the mounting plates 14 as shown in FIG. 1, or alternatively the support axles 16 rotatably mount a plurality of wheels 20 between the mounting plates 14 in an in-line configuration. By this structure, an individual can accomplish either rolling or sliding traversing of the in-line roller ice skate 10 over a ground surface as desired.

Figure 3:
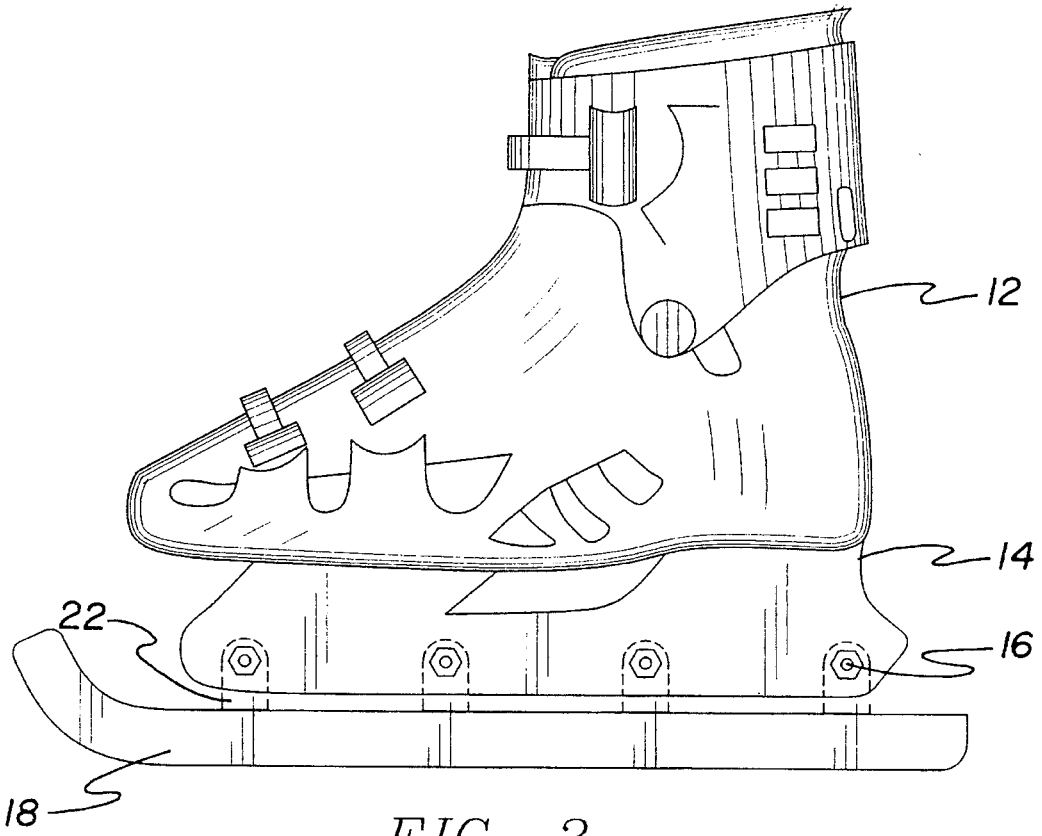
FIG. 3 is an elevation view of the invention with the ice blade.
Figure 4:
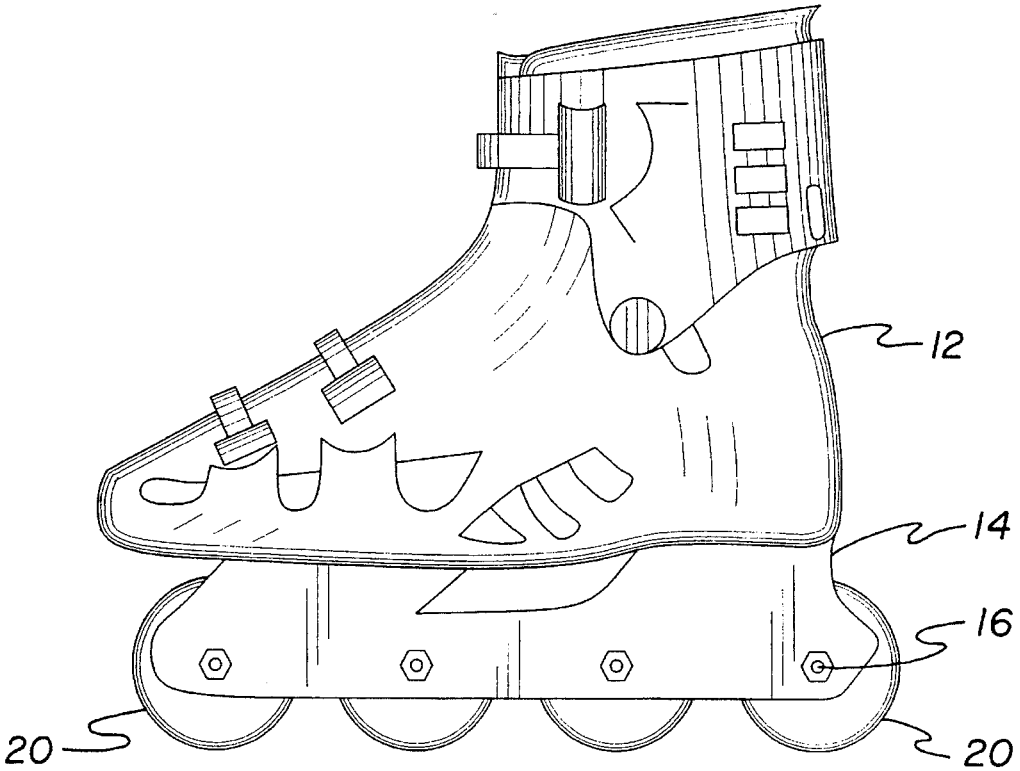
FIG. 4 is an elevation view of the invention with the wheel.
Figure 5:
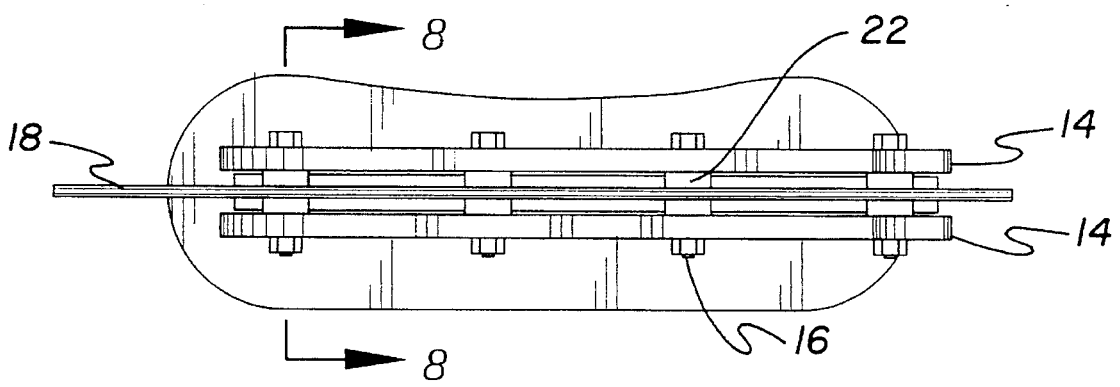
FIG. 5 is a bottom plan view of the invention with the ice blade.
Figure 6:
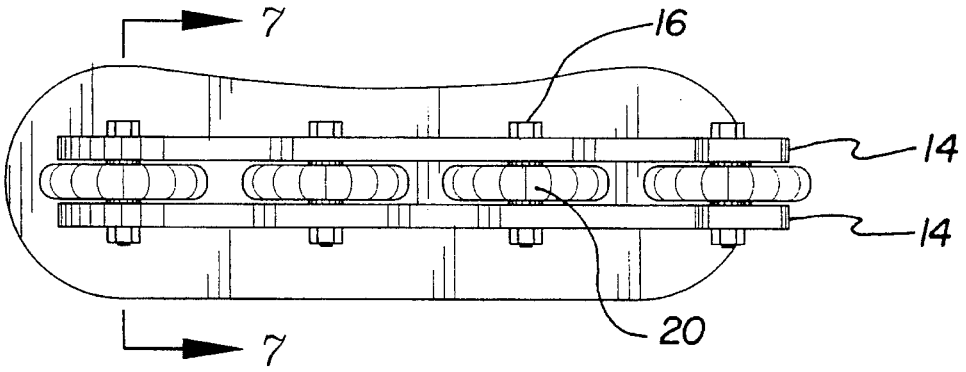
FIG. 6 is a bottom plan view of the invention with the wheels.
Figure 7:
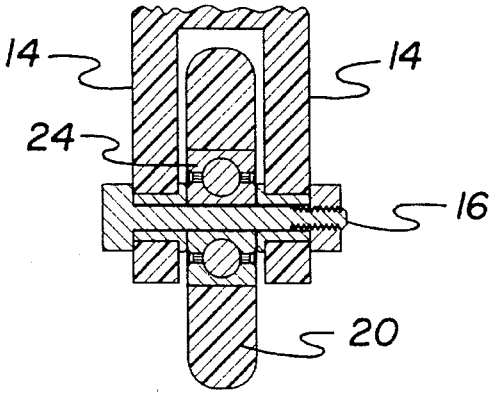
FIG. 7 is a cross sectional view taken along line 7—7 of FIG. 6.
Figure 8:
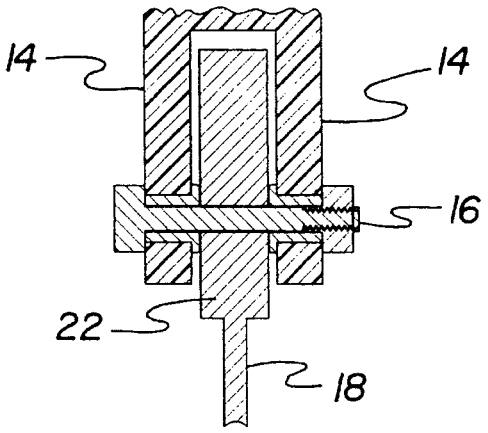
FIG. 8 is a cross sectional view taken along line 8—8 of FIG. 5.

Referring now to FIGS. 3 through 8 wherein the present invention 10 is illustrated in detail, it can be shown that the axles 16 are directed through the mounting plates 14 and positioned in a substantially spaced and parallel orientation relative to one another. As shown in FIGS. 3, 5, and 8, the ice blade 18 includes a plurality of support stanchions 22 projecting therefrom which extend in between the mounting plates 14. Each of the support stanchions 22 is shaped so as to define an unlabeled aperture directed therethrough permitting passage of an individual one of the axles 16 through the support stanchions so as to mount the ice blade 18 beneath the boot 12 and the mounting plates 14 substantially as shown in FIG. 3 of the drawings. As shown in FIG. 8, the support stanchions 22 are preferably of a first transverse thickness, with the ice blade 18 being of a second transverse thickness, wherein the first transverse thickness is substantially greater than the second transverse thickness such that each of the support stanchions 22 closely engages interior surfaces of the spaced mounting plates 14. By this structure, each of the support stanchions 22 is mounted relative to the mounting plates 14 by an individual one of the axles 16 projecting therethrough.

Referring now to FIGS. 4, 6, and 7, it can be shown that the wheels 20 each include a roller bearing 24 centrally mounted therewithin through which a respective one of the axles 16 projects to rotatably mount the wheel between the mounting plates 14. As specifically shown in FIG. 7, it is desirable to have a pair of bushings extending circumferentially about a respective one of the axles 16 and abuttingly engaging opposed sides of an interior race of the bearing 24 of a respective one of the wheels 20. The bushings operate to space the respective wheel 20 a predetermined distance from interior surfaces of the mounting plates 14 so as to preclude interference or frictional engagement therebetween.

Referring now to FIGS. 9 through 11, it can be shown that each of the axles 16 projects laterally beyond the mounting plates 14 and may be configured so as to provide for a quick manual release without the use of tools. To this end, each of the axles 16 may include exterior threads 26 formed about an exterior portion of a first end thereof, with an adjustment nut 28 being threadably engaged to the exterior threads. Further, the axles 16 can be shaped so as to define a bifurcated second end having a cam 30 mounted between spaced furcations of the second end. The cam 30 is rotatably mounted relative to the second end of the axle 16 and includes a lever 32 projecting therefrom which can be manually manipulated to affect rotation of the cam 30. By this structure, the cam 30 can be selectively rotated so as to pre-tension the axles 16 so as to secure the same relative to the mounting plates 14 with either the wheels 20 or the ice blade 18 positioned therebetween.

In use commonly in-line roller ice skate 10 of the present invention easily utilized for facilitating rolling or sliding traversing over a ground surface. To this end, either the ice blade 18 or the wheels 20 can be selectively positioned between the mounting plates 14 either through a use of tools in conjunction with the support axle 16 illustrated in FIGS. 1 through 8 of the drawing, or without the use of tools in conjunction with the axle configuration illustrated in FIGS. 9 through 11.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United. States is as follows:

1. An alternately useable in-line roller and ice skate combination comprising:

an ice blade;

a plurality of wheels;

a boot adapted to be the secured to a human foot;

a pair of mounting plates positioned in a substantially spaced and parallel orientation relative to one another and extending longitudinally along a lower surface of the boot so as to project downwardly therefrom;

a plurality of support axles extending between the mounting plates to secure either of the ice blade and the plurality of wheels between the mounting plates the axles are directed through the mounting plates and positioned in a substantially spaced and parallel orientation relative to one another;

the ice blade including a plurality of support stanchions projecting therefrom and extending in between the mounting plates when the ice blade is coupled thereto, each of the support stanchions being shaped so as to define an aperture directed therethrough permitting passage of an individual one of the axles through the support stanchion so as to mount the ice blade beneath the boot and the mounting plates;

the support stanchions being of a first transverse thickness, with the ice blade being of a second transverse thickness, wherein the first transverse thickness is substantially greater than the second transverse thickness such that each of the support stanchions closely engages interior surfaces of the spaced mounting plates;

the wheels each including a roller bearing centrally mounted therewithin through which a respective one of the axles projects to rotatably mount the respective wheel between the mounting plates when the wheels are coupled thereto;

a plurality of bushings being arranged in pairs of bushings extending circumferentially about a respective one of the axles, the bushings abuttingly engaging opposed sides of an interior race of the bearing of a respective one of the wheels;

the axles each projecting laterally beyond the mounting plates, with each of the axles including exterior threads formed about an exterior portion of a first end thereof, with an adjustment nut being threadably engaged to the exterior threads, and the axles being further shaped so as to define a bifurcated second end having a cam mounted between spaced furcations of the second end, the cam being rotatably mounted relative to the second end of the axle and including a lever projecting therefrom which can be manually manipulated to affect rotation of the cam into engagement within an exterior of one of the mounting plates to tension the respective axle and secure the axle relative to the mounting plates with either of the wheels and the ice blade positioned therebetween.

* * * * *